US005605225A

United States Patent [19]

Schaeffer

[11] Patent Number: 5,605,225

[45] Date of Patent: Feb. 25, 1997

[54] PUSH-PULL TYPE LATCHING CONTROL BUTTON, IN PARTICULAR FOR ACTUATING AN ELECTRICAL COMPONENT

[75] Inventor: Maurice Schaeffer, Strasbourg, France

[73] Assignee: Baco Constructions Electriques Anct.Baumgarten, Strasbourg, France

[21] Appl. No.: 558,852

[22] Filed: Nov. 15, 1995

[30] Foreign Application Priority Data

Nov. 16, 1994 [FR] France ..... 94 13690

[51] Int. Cl.[6] ..... H01H 3/20

[52] U.S. Cl. ..... 200/539; 200/538; 200/308

[58] Field of Search ..... 200/538, 539, 200/520, 523, 540, 330, 331, 341, 342, 345, 308

[56] References Cited

U.S. PATENT DOCUMENTS

| | | | |
|---|---|---|---|
| 3,721,789 | 3/1973 | Black . | |
| 4,032,731 | 6/1977 | Bryceland | 200/540 |
| 4,255,633 | 7/1981 | Johnston et al. | 200/538 |
| 5,345,050 | 9/1994 | Branch et al. | 200/538 |
| 5,408,061 | 4/1995 | Martin | 200/538 |

FOREIGN PATENT DOCUMENTS

| | | |
|---|---|---|
| 2212626 | 7/1974 | France . |
| 2811320 | 9/1979 | Germany . |
| 3207725 | 9/1983 | Germany . |
| 3608569 | 9/1987 | Germany . |

*Primary Examiner*—David J. Walczak
*Attorney, Agent, or Firm*—Young & Thompson

[57] ABSTRACT

In a push-pull type latching control button, in particular a button for operating an electrical component, a main plunger of the control button is associated with an auxiliary plunger through which a shank of a control member can actuate the main plunger. Like the main plunger, the auxiliary plunger is releasably retained by a latching arrangement. An elastic spreader arrangement is provided between the main plunger and the auxiliary plunger. The elastic spreader arrangement also constitutes a return spring arrangement associated with the control member.

20 Claims, 3 Drawing Sheets

PUSH-PULL TYPE LATCHING CONTROL BUTTON, IN PARTICULAR FOR ACTUATING AN ELECTRICAL COMPONENT

BACKGROUND OF THE INVENTION

1. Field of the invention

The present invention concerns control buttons that must be depressed to operate an underlying component of any kind, for example an electrical component of any kind.

2. Description of the prior art

Usually called "mushroom head pushbuttons" when their shape is such that they can be actuated with the palm of the hand, these control buttons usually include a guide body by means of which they can be mounted on any kind of support, a plunger to actuate the underlying component axially mobile in the guide body in the manner of a piston, a control member in the general shape of a mushroom axially mobile in the guide body between an "out" inactive position and an "in" active position and having a head to be actuated by the user and a shank to actuate the plunger, and, associated with said control member, return spring means which urge it at all times towards its "out" inactive position.

The present invention is more particularly concerned with control buttons known as "push-pull type latching" control buttons which further include latching means on the path of movement of the plunger adapted to retain the latter releasably in at least one axial direction, namely the axial direction from the "in" active position to the "out" inactive position of the control member and, operative between the plunger and the shank of the control member, lost motion coupling means enabling the control member to apply traction to the plunger to return the control member to its "out" inactive position.

One example of the use of these control buttons is to stop plant quickly and permanently in an emergency.

To stop the plant all that is required is to depress the control member.

This moves the plunger towards the component in order to actuate it, for example to switch it from a first state to another state.

At the same time, the plunger catches under the latching means and, retained by the latter, it retains the control member in the "in" active position which holds the underlying component in its new state.

To return this component to its initial state, i.e. to bring about the reverse switching of this component from one state to the other, sufficient traction must be applied to the control member for the plunger, entrained by the control member, to overcome the resistance of the latching means and move in the opposite axial direction and thereby release the component.

In practise, however, given the travels available, the plunger actuates the underlying component before it passes the latching means.

In other words, this component is switched from one state to the other before the plunger and therefore the control member are latched.

Consequently, if the control member is released before latching takes place, the underlying component inevitably returns to its initial state, after being temporarily switched to another state.

In other words, the underlying component unintentionally changes state twice in succession.

A general object of the present invention is an arrangement avoiding this drawback.

SUMMARY OF THE INVENTION

The present invention consists in a control button of the kind including a guide body by means of which it is adapted to be mounted on a support of any kind, a plunger mounted to move axially in said guide body in the manner of a piston to actuate any underlying component, elastically retractable latching means on the path of movement of said plunger for releasably retaining the latter in at least one axial direction, a control member mounted to move axially in said guide body between an "out" inactive position and an "in" active position and having a head to be actuated by a user and a shank for actuating said plunger, return spring means adapted to urge said control member towards its "out" inactive position, lost motion coupling means between said plunger and said shank of said control member enabling application of traction to said plunger through the intermediary of said control member, an auxiliary plunger between said main plunger and said shank of said control member and aligned with said main plunger, through the intermediary of which said shank of said control member can actuate said main plunger and which is also adapted to be releasably retained by said latching means, and elastic spreader means operative between said main plunger and said auxiliary plunger and constituting said return spring means associated with said control member.

An arrangement of this kind has the advantage of providing sufficient axial travel of the main plunger for its actuation of the underlying component, and the switching of the latter from one state to another, not to occur until after it has passed the latching means.

In other words, the state of the underlying component is not changed before latching takes place, with the advantage that unintentional early releasing of the control member has no effect.

After passing the latching means, by moving away from the auxiliary plunger the main plunger has all the axial travel necessary for reliable and prompt actuation of the underlying component, without risk of the latter being unintentionally released before traction is properly applied to the control member for this purpose.

In accordance with a complementary feature of the invention, a visual position indicator is preferably associated with the control member and mobile between two positions, namely a retracted position it adopts when the control member is in the "out" inactive position and a deployed position it adopts when the control member is in the "in" active position, and this visual indicator has at least one portion which, concealed in the retracted position, becomes visible in the deployed position.

Accordingly, the "out" inactive position or the "in" active position of the control member is clearly indicated, even though the travel of the control member between these positions is usually too small for its position to be unambiguously determined by simple visual examination.

The features and advantages of the invention will emerge from the following description given by way of example with reference to the appended diagrammatic drawings.

DETAILED DESCRIPTION OF THE PREFERRED EMBODIMENTS

Figure 1:
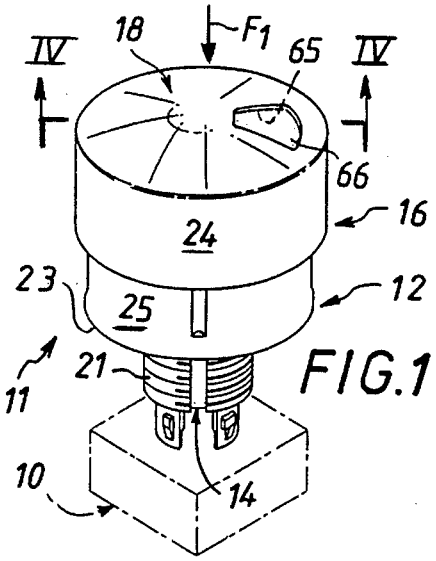
FIG. 1 is a perspective view of a control button in accordance with the invention with its control member in the "out" inactive position.
Figure 2:
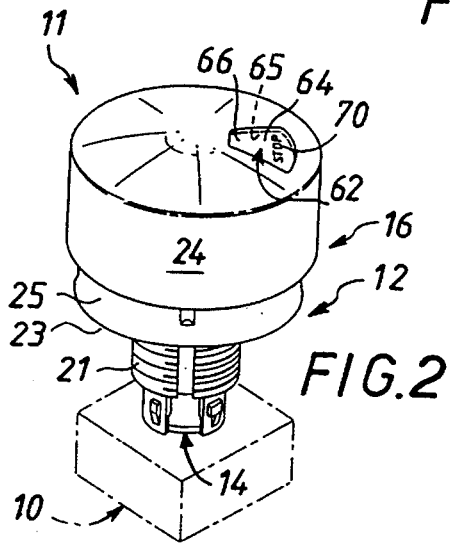
FIG. 2 is a perspective view showing the control member in the "in" active position.

As shown diagrammatically in FIGS. 1 and 2, the overall aim is to actuate a component 10 of any kind, for example an electrical component of any kind, such as a switch, to change its state, i.e. to change it from one state to another.

Figure 4:
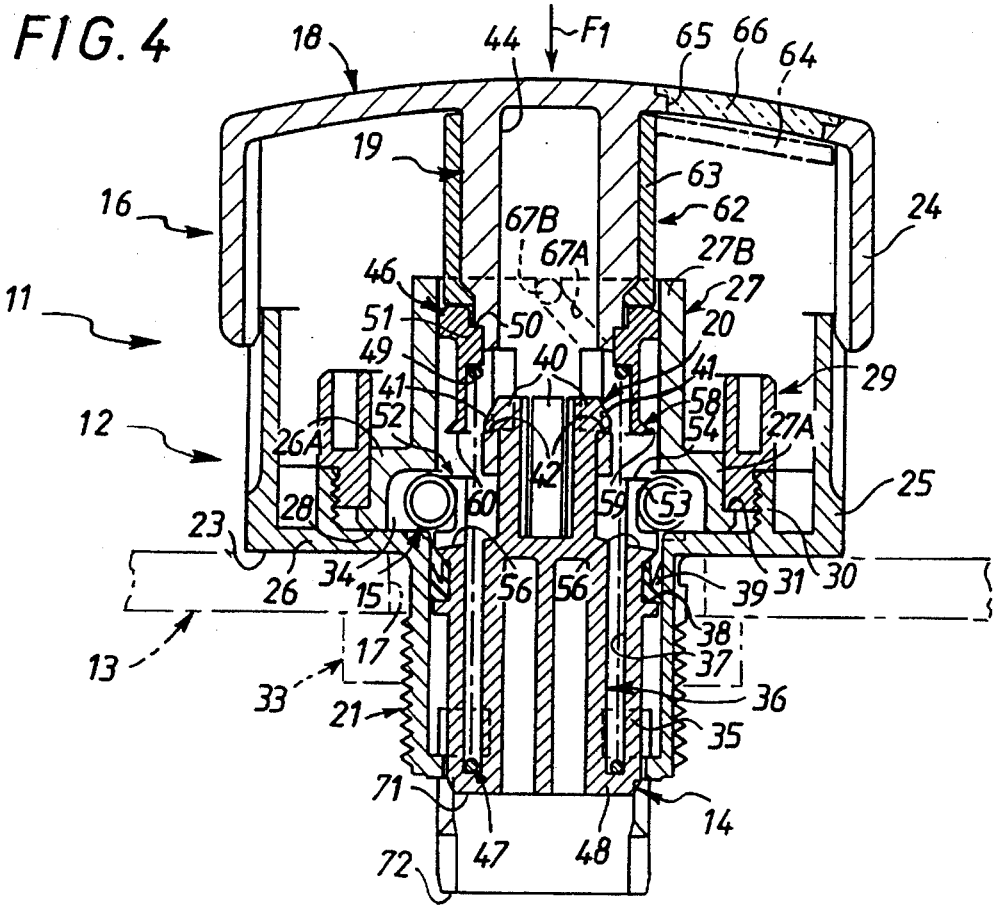
FIG. 4 is a view of the control button in section on the line IV—IV in FIG. 1 and to a different scale.
Figure 5A:
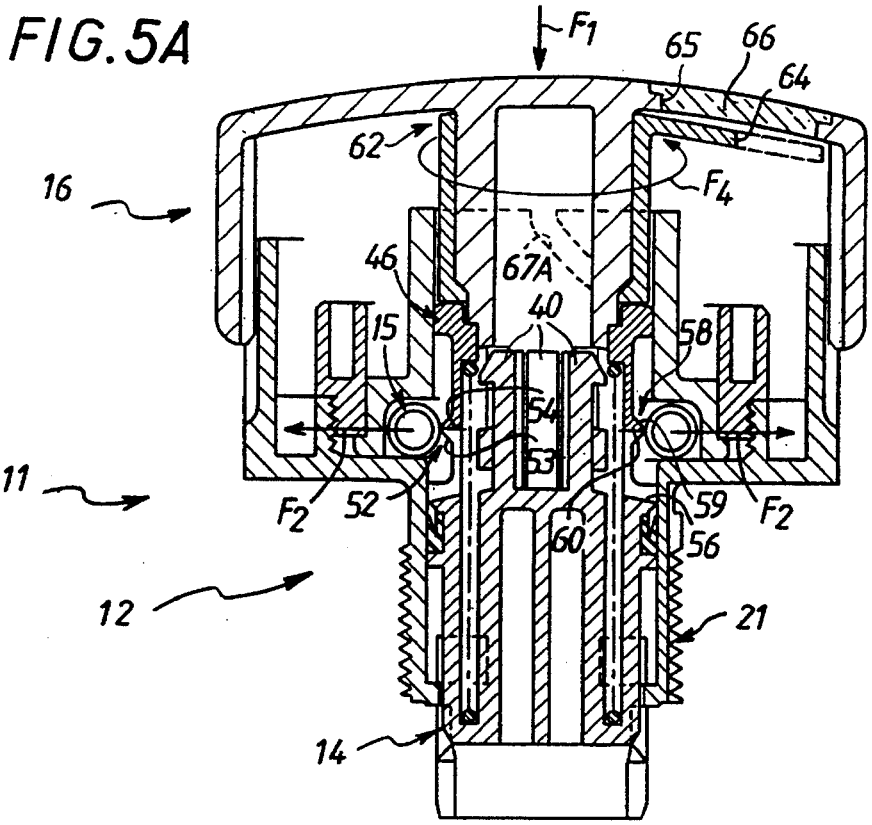
FIGS. 5A, 5B and 5C are views in axial section analogous to that of FIG. 4 and showing various successive phases of operation of the control button of the invention.
Figure 5B:
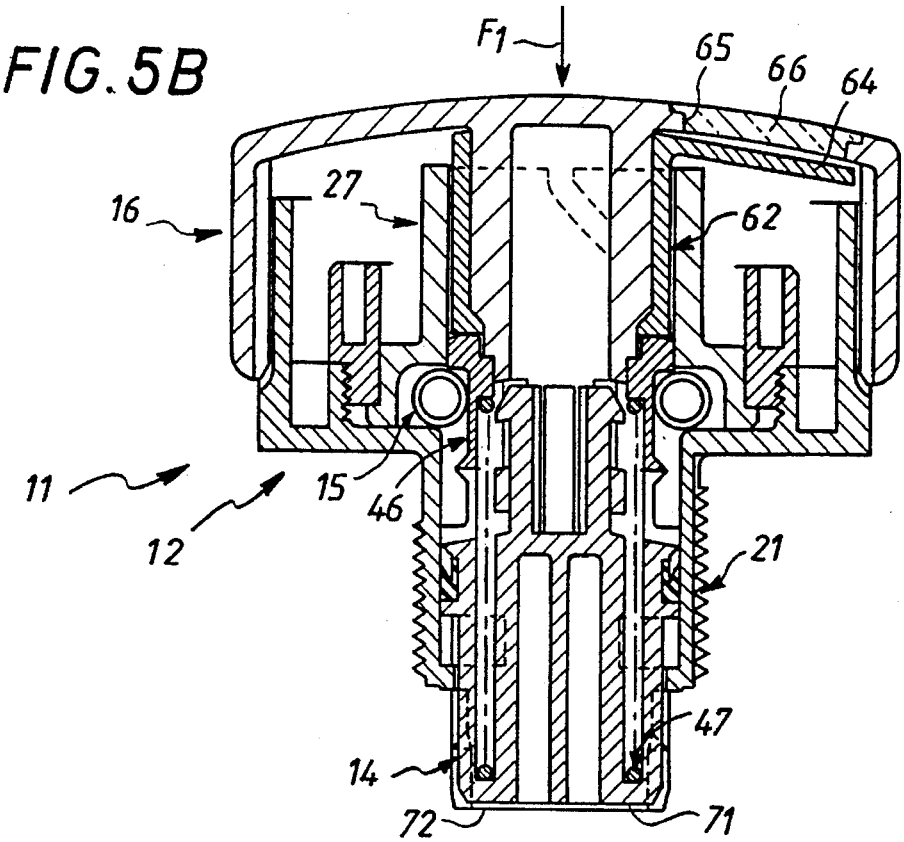
Figure 5C:
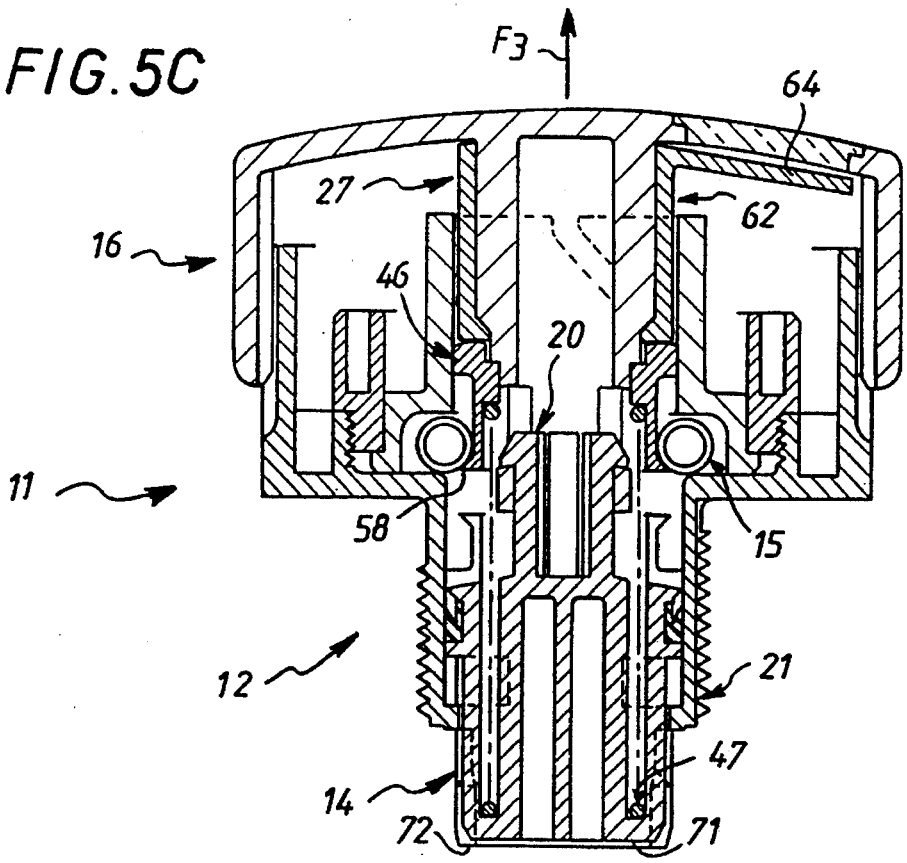

The component 10 is actuated by a control button 11 including a guide body 12 by means of which it is mounted on a support 13 of any kind, shown diagrammatically in chain-dotted line in FIG. 4, a plunger 14 which is axially mobile, in the manner of a piston, in the guide body 12 to actuate the Underlying component 10, elastically retractable latching means 15 on the path of movement of the plunger 14 to retain the latter releasably in at least one axial direction, a control member 16 in the general shape of a mushroom axially mobile in the guide body 12 between an "out" inactive position shown in FIGS. 1 and 4 and an "in" active position shown in FIGS. 2 and 5C, the control member 16 having a head 18 to be actuated by the user and a shank 19 for actuating the plunger 14, return spring means which, as described in more detail below, urge the control member 16 at all times towards its "out" inactive position, and, operative between the plunger 14 and the shank 19 of the control member 16, also as described in more detail below, lost motion coupling means 20 which enable application of traction to the plunger 14 in the opposite axial direction and through the intermediary of the control member 16.

As shown diagrammatically in FIG. 4, the support 13 is a simple plate with a hole 17 in it in which a screwthreaded portion 21 of the guide body 12 is engaged.

In practise the hole 17 in the support 13 and the screwthreaded portion 21 of the guide body 12 have a circular contour.

A shoulder 23 on the guide body 12 bears against one side of the support 13 and a nut 33 screws onto the screwthreaded portion 21 on the opposite side to fasten it to the support 13.

In the embodiments shown the head 18 of the control member 16 has a circular contour in plan view and includes a peripheral skirt 24 cooperating with a fixed guide sleeve 25 that prevents it from rotating.

In practise the sleeve 25 is in one piece with the guide body 12.

It is located at the periphery of a circular contour bottom plate 26 constituting a radial enlargement at the upper end of the screwthreaded portion 21 whose lower surface forms the shoulder 23.

In the embodiments shown the latching means 15 comprise an annular spring extending around the axis of the assembly and prevented from moving axially relative to the guide body 12.

In practise this is a circular cross-section tension coil spring with its ends joined together in a closed loop.

A fixed ring 27 for axially retaining the spring constituting the latching means 15 coaxial with the guide body 12 is aligned with the screwthreaded portion 21 of the latter and is prevented from moving axially and circumferentially relative to the guide body 12.

For reasons that emerge below, the ring 27 in practise has two successive sections of different diameter, namely a greater diameter section 27A in its lower part, the edge 28 of which is applied to the bottom plate 26 of the guide body 12, and a smaller diameter section 27B in its upper part extending freely around the shank 19 of the control member 16, at a distance from the latter.

The flange 29 screwed onto a bush 30 in one piece with the bottom plate 26 of the guide body 12 holds the ring 27 pressed against the bottom plate 26, bearing to this end on a shoulder 31 projecting for this purpose from the larger diameter section 27A of the ring 27.

To prevent it rotating relative to the guide body 12 the ring 27 has circumferentially spaced lugs 32 projecting from the edge 28 of its larger diameter section 27A. These engage with openings (not shown) in corresponding relationship to them on the bottom plate 26 of the guide body 12.

The larger diameter section 27A of the ring 27 cooperates with the bottom plate 26 of the guide body 12 to define an internal housing 34 at its base containing the ring constituting the latching means 15.

The size of the housing 34 in the radial direction is sufficient to allow some radial expansion of the latching means 15.

For reasons that emerge below, the plunger 14 is referred to hereinafter as the main plunger. It includes, in one piece with it, a peripheral flange 35 by means of which it slides in the guide body 12, to be more precise in the screwthreaded portion 21 of the latter, and a concentric central shank 36 higher than the peripheral flange 35 and joined to the latter at the bottom. The flange 35 and the shank 36 have a circular contour in the embodiments shown. The lost motion coupling means 20 between this assembly and the shank 19 of the control member 16 operate on the central shank 36. There is an annular blind recess 37 between the peripheral flange 35 and the central shank 36.

In the embodiments shown the peripheral flange 35 of the main plunger 14 carries an external seal 39, in practise a lip seal, housed in an annular groove 38.

In the embodiments shown the lost motion coupling means 20 operative between the main plunger 14 and the shank 19 of the control member 16 include on either the main plunger 14 or the shank 19 at least one elastically deformable lug 40 which is elongate in the direction parallel to the axis of the assembly and carries a transversely projecting bead 41. The other component (i.e. either the shank 19 or the main plunger 14, as appropriate) incorporates a recess 42 in which the bead 41 can move.

In practise at least two elastically deformable lugs 40 are provided, equi-angularly distributed around the axis of the assembly. They are formed by the free end of the central shank 36 of the main plunger 14, which is divided into section by slots for this purpose.

The corresponding recesses 42 are part of the shank 19 of the control member 16.

To this end the shank 19 is hollow with an interior bore 44 into which extends the free end of the central shank 36 of the main plunger 14 forming the elastically deformable lugs 40.

In the embodiment specifically shown in FIGS. 1 through 5 the bore 44 in the shank 19 of the control member 16 is closed at the surface of the head 18 of the control member 16 and the openings 42 are localized windows in the shank 19.

In accordance with the invention the control button 11 includes an auxiliary plunger 46 associated with the main plunger 14, between the main plunger 14 and the shank 19 of the control member 16 and aligned with the main plunger 14. Through this auxiliary plunger 46 the shank 19 of the control member 16 actuates the main plunger 14. The auxiliary plunger 46 is also adapted to be releasably retained by the latching means 15. Elastic spreader means 47 operative between the main plunger 14 and the auxiliary plunger 46 constitute the return spring means associated with the control member 16.

In practise the elastic spreader means 47 comprise an annular compression coil spring in the blind recess 37 in the main plunger 14 and bearing against the bottom 48 of the blind recess 37 and against a shoulder 49 provided for this purpose on the inside of the auxiliary plunger 46.

In practise the auxiliary plunger 46 is an annular component fitting around the shank 19 of the control member 16, between the latter and the smaller diameter section 27B of the ring 27, and slides in the latter.

At a distance from the shoulder 49 the auxiliary plunger 46 has a second shoulder 50 on its inside which is oriented in the opposite direction and through which it is pressed by the elastic spreader means 47 against a shoulder 51 provided for this purpose on the outside of the shank 19 of the control member 16.

The auxiliary plunger 46 is axially aligned with the peripheral flange 35 of the main plunger 14.

For its temporary retention by the latching means 15, the main plunger 14 has an annular outwardly projecting bead 52 on the peripheral flange 35 at the end near the auxiliary plunger 46. At least the flank 53 of the bead 52 facing away from the auxiliary plunger 46 is oblique to the axis of the assembly, moving closer to this axis in the direction away from the auxiliary plunger 46.

In practise, the other flank 54 of the bead 52 is substantially perpendicular to the axis of the assembly, forming the corresponding end of the main plunger 14, to be more precise the corresponding end of its peripheral flange 35.

To facilitate molding of the elastically deformable lugs 40, the end of the peripheral flange 35 of the main plunger 14 carrying the bead 52 is notched in the embodiments shown, the notches 56 being in corresponding relationship with the elastically deformable lugs 40, above the annular groove 38 housing the seal 39.

For its temporary retention by the latching means 15, the auxiliary plunger 46 has an annular outwardly projecting bead 58 at its end near the main plunger 14. At least the flank 59 of the bead 58 facing away from the main plunger 14 is oblique to the axis of the assembly, moving closer to this axis in the direction away from the main plunger 14.

In practise, the other flank 60 of the bead 58 is substantially perpendicular to the axis of the assembly, forming the corresponding end of the auxiliary plunger 46.

In the embodiments shown the control member 16 is associated with a visual position indicator 62 mobile between two positions, namely a retracted position (FIGS. 1 and 4) it adopts when the control member 16 is in the "out" inactive position and a deployed position (FIGS. 2 and 5C) it adopts when the control member 16 is in the "in" active position. At least part of this visual indicator is concealed in the retracted position and becomes visible in the deployed position, as explained below.

In the embodiments shown, the visual position indicator 62 in practise includes a hub 63 around the shank 19 of the control member 16, above the auxiliary plunger 46, and a circular sector shaped enlargement 64 forming a wing under the head 18 of the control member 16. The head 18 of the control member 16 incorporates a window 65 on the path of movement of this enlargement 64.

In the embodiments shown the window 165 is in practise closed by a transparent plate 66.

Cam means 67 are provided between the visual position indicator 62 and the fixed ring 27 for rotating it.

The cam means 67 in practise include at least one helical groove 67A on the ring 27 and, in corresponding relationship thereto, at least one lug 67B on the visual position indicator 62 engaged in the helical groove 67A.

Two grooves 67A and therefore two lugs 67B are provided, for example, as shown here.

The ring 27 associated in this way with the visual position indicator 62 for rotating the latter is like the latter associated with the auxiliary plunger 46, which acts as a guide for it.

The grooves 67A are in its smaller diameter section 27B.

Figure 3:
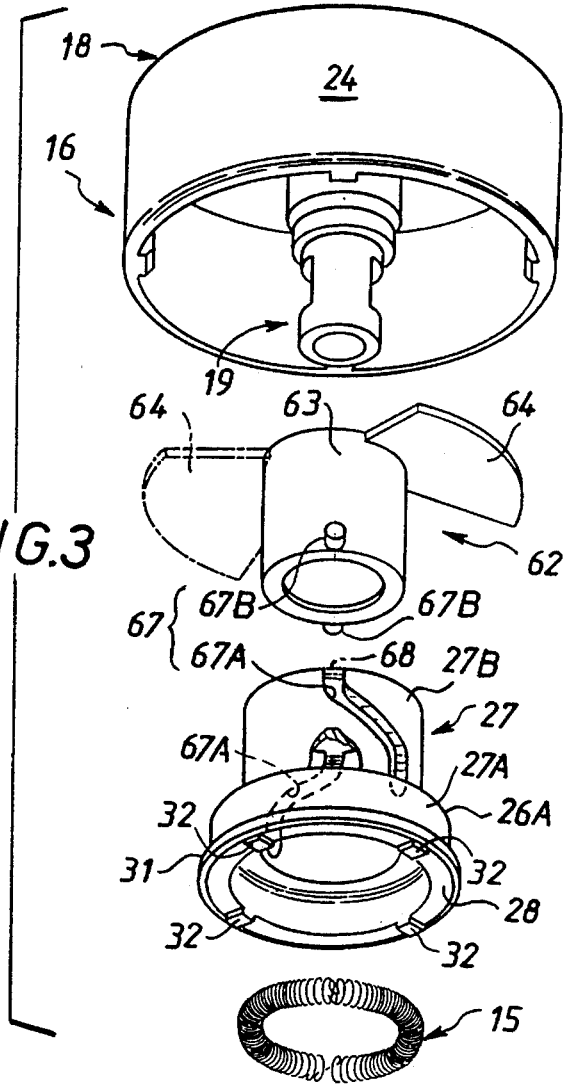
FIG. 3 is a bottom perspective view of some components of the control button shown to a larger scale.

For example, as shown in continuous line in FIG. 3, they extend to the full thickness of this smaller diameter section 27B over all of their length.

However, and as shown in dashed line in FIG. 3, a thinner bridge 68 may be provided between their two lips at their outlet to avoid conewise opening of the smaller diameter section 27B of the ring 27.

As shown in continuous line in FIG. 3 the visual position indicator 62 has only one enlargement 64 and this can carry any legend 70 (see FIG. 2).

However, as shown in chain-dotted line in FIG. 3, two identical enlargements 64 may be provided to enable the visual position indicator 62 to be mounted either way around relative to the shank 19 of the control member 16.

The visual position indicator 62 is preferably colored.

In the "out" inactive position shown in FIGS. 1 and 4 the bead 52 on the main plunger 14 is hooked onto the spring constituting the latching means 15 and, retained by this spring, it is in an uppermost position in the guide body 12, its free end 71 being set back a considerable distance from the free end 72 of the screwthreaded portion 21 of the latter.

Retracted into the guide body 12 in this way, the main plunger 14 is at a distance from the component 10 which is in any first state, for example.

At the same time, the lugs 67B on the visual position indicator 62 are engaged with the grooves 67A on the ring 27, near the outlet of the latter, and the design is such that the enlargement 64 of the visual position indicator 62 is at this time angularly spaced from the window 65 in the head 18 of the control member 16.

At the same time, the auxiliary plunger 46, pushed back by the elastic spreader means 47, is at a distance from the main plunger 14, being retained, through the intermediary of the control member 16, by the lost motion coupling means 20 operative between the shank 19 of the control member 16 and the main plunger 14.

If the control member 16 is depressed axially in the direction of the arrow F1 in FIGS. 1, 4, 5A and 5B it is moved from its "out" inactive position towards its "in" active position, entraining with it the auxiliary plunger 46.

After the distance initially separating it from the main plunger 14 is taken up, the auxiliary plunger 46 bears on the latter.

As the inward movement of the control member 16 continues, the auxiliary plunger 46 causes the main plunger 14 to overcome the resistance of the spring constituting the latching means 15, causing temporary radial expansion of the latter, as shown diagramatically by the arrows F2 in FIG. 5A.

In practise, the bead 58 on the auxiliary plunger 46 moves past the latching means 15 at the same time as and cojointly with the bead 52 on the main plunger 14.

As the inward movement of the control member 16 continues (FIG. 5B) the main plunger 14, pushed back by the auxiliary plunger 46, reaches its lowermost position in which, as shown, its free end 71 is substantially level with the free end 72 of the screwthreaded portion 21 of the guide body 12.

Accordingly it actuates the component 10 which is switched from its first state to another state.

If the control member 16 is released at this time, the auxiliary plunger 46 and the control member 16 are pushed back by the elastic spreader means 47 towards the "out" inactive position of the control member 16, as shown by the arrow F3 in FIG. 5C.

The bead 58 on the auxiliary plunger 46 therefore hooks onto the spring constituting the latching means 15, as shown in FIG. 5C, in the axial direction opposite that in which the main plunger 14 was previously hooked onto the same latching means 15, and the design is such that the force of the spring constituting the spreader means 47 is less than that required to move past the latching means 15.

The auxiliary plunger 46 is therefore retained by the latching means 15 and, consequently, the main plunger 14 is itself held in its lowermost position in the guide body 12 by the elastic spreader means 47.

As the main plunger 14 therefore remains in contact with the component 10, the latter remains in the same state.

In practise, this is advantageously so even if the control member 16 is inadvertently released as soon as it moves past the latching means 15.

Bearing on the auxiliary plunger 46, retained at this time by the latching means 15, the elastic spreader means 47 urge the main plunger 14 towards its lowermost position and hold it in that position.

When the main plunger 14 is in its lowermost position it holds the control member 16 in its "in" active position through the lost motion coupling means 20 operative between it and the shank 19 of the control member 16.

As the control member 16 is depressed, the visual position indicator 62 is rotated about the shank 19 of the control member 16, as shown by the arrow F4 in FIG. 5A, by the cam means 67 operative between it and the fixed ring 27.

Its enlargement 64 therefore moves progressively from its retractive position shown in chain-dotted line in FIG. 4 to its deployed position shown in full line in FIGS. 5B and 5C.

To return the control member 16 to the "out" inactive position sufficient force must be applied to it in the direction of the arrow F3 in FIG. 5C for the bead 58 on the auxiliary plunger 46 to overcome the resistance of the latching means 15.

Entrained by the control member 16, because of the lost motion coupling means 20 operative between it and the latter, the main plunger 14 is then itself returned to its initial uppermost position, as shown in FIG. 4.

This releases the component 10 which returns to its first state.

Figure 6:
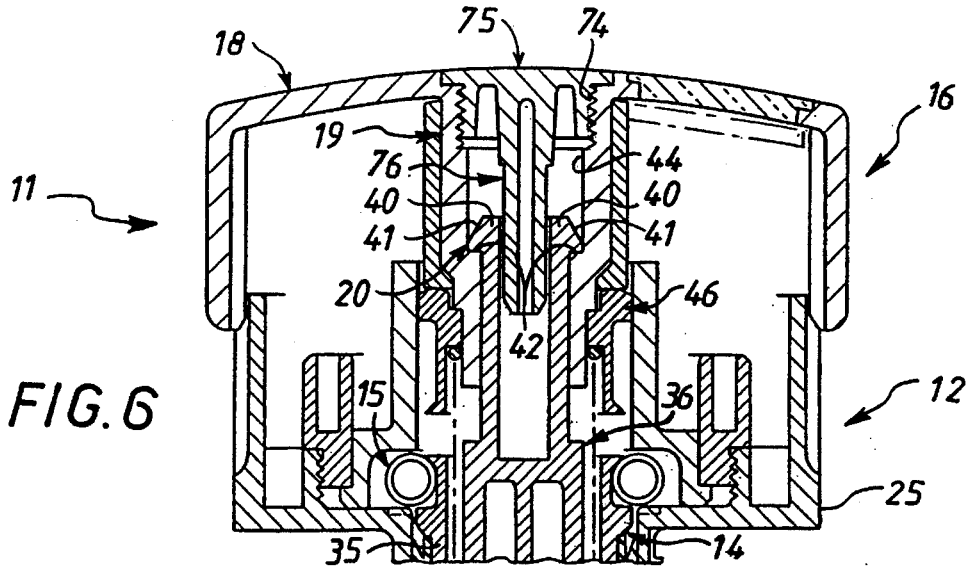
FIG. 6 is a partial view in axial section, analogous to part of FIG. 4, and relating to a different embodiment.

In the embodiment shown in FIG. 6 the head 18 of the control member 16 has an opening 74 in its central area continuous with the bore 44 in the shank 19 and providing access to the elastically deformable lugs 40 on the lost motion coupling means 20.

It is therefore possible to release these lugs to separate the control member 16 from the main plunger 14 and thus to demount the control button 11 as a whole, if necessary.

In the embodiment shown, the opening 74 is closed by a removable plug 75 and the latter carries an axial column 76 which braces the elastically deformable lugs 40 of the lost motion coupling means 20, to prevent them accidentally escaping from the openings 42 with which they cooperate.

In practise, in the embodiment shown, these openings 42 are simply a shoulder inside the bore 44 in the shank 19.

The plug 75 screws into the opening 74, for example, as shown here.

Of course, the present invention is not limited to the embodiments described and shown but encompasses any variant execution and/or combination of their various component parts.

There is claimed:

1. Control button comprising a guide body for mounting the control button on a support, a main plunger mounted for axial reciprocating movement along a path and adapted to actuate an underlying component, retractable latching means disposed on the path of movement of said plunger for releasably retaining said main plunger in at least one axial direction, a control member mounted to move axially in said guide body between an "out" inactive position and an "in" active position, said control member having a head adapted to be actuated by a user and a shank for actuating said plunger, return spring means for urging said control member towards the "out" inactive position, lost motion coupling means between said main plunger and said shank of said control member for applying traction to said main plunger by means of said control member, an auxiliary plunger disposed between said main plunger and the shank of said control member and aligned with said main plunger, said shank of said control member arranged to actuate said main plunger by-means of said auxiliary plunger, said auxiliary plunger also being releasably retained by said latching means, and said return spring means comprising elastic spreader means operative between said main plunger and said auxiliary plunger.

2. Control button according to claim 1 wherein the control button has an axis, said main plunger having a projecting bead at an end near said auxiliary plunger for temporary retention by said latching means, and said bead having at least one flank facing away from said auxiliary plunger and lying oblique to the axis of the control button.

3. Control button according to claim 2 wherein said bead of said main plunger has another flank substantially perpendicular to the axis of the control button forming a corresponding end of said main plunger.

4. Control button according to claim 1 wherein the control button has an axis, said auxiliary plunger having a projecting bead at an end near said main plunger for temporary retention by said latching means, and said bead having at least one flank facing away from said main plunger and lying oblique to the axis of the control button.

5. Control button according to claim 4 wherein said bead of said auxiliary plunger has another flank substantially perpendicular to the axis of the control button forming a corresponding end of said auxiliary plunger.

6. Control button according to claim 1, wherein said auxiliary plunger is mounted to slide in a fixed ring.

7. Control button according to claim 6 wherein the control button has an axis, said spreader means comprising an annular spring disposed around said axis of the control button and restrained against axial movement relative to said guide body, and said fixed ring forms with said guide body a housing for said latching means.

8. Control button according to claim 1 wherein said spreader means comprises an annular spring disposed around the axis of the control button and restrained against axial movement relative to said guide body.

9. Control button according to claim 8 wherein said latching means comprises a circular cross-section tension coil spring having ends joined together to form a closed loop.

10. Control button according to claim 1 wherein the control button has an axis, said lost motion coupling means between said main plunger and said shank of said control member including on one of said main plunger and said shank at least one elastically deformable lug elongate in a direction parallel to the axis of the control button and incorporating a transversely projecting hooking bead and an opening on the other of one of said shank and said main plunger, said bead being axially moveable in said opening.

11. Control button according to claim 10 wherein said head of said control member has an opening in a central area providing access to said at least one elastically deformable lug.

12. Control button according to claim 11 wherein said control member has an associated visual position indicator mobile between a retracted position when said control member is in said "out" inactive position and a deployed position when said control member is in said "in" active position, at least part of said visual position indicator being hidden in said retracted position and becoming visible in said deployed position.

13. Control button according to claim 12 wherein said visual position indicator is mounted to rotate about said shank of said control member.

14. Control button according to claim 12 wherein said visual position indicator includes a hub rotatable around said shank of said control member and at least one enlargement under said head of said control member, said head of said control member including a localized window on a path of movement of said enlargement.

15. Control button according to claim 12 wherein cam means for rotating said visual position indicator being provided between said visual position indicator and a fixed ring.

16. Control button according to claim 15 wherein said cam means includes at least one helical groove on said fixed ring and at least one lug on said visual position indicator engageable with said groove.

17. Control button according to claim 15 wherein said auxiliary plunger is mounted to slide in said fixed ring, and said cam means for rotating said visual position indicator being provided between said visual position indicator and said fixed ring.

18. Control button according to claim 11 wherein said opening in said head of said control member is closed by a removable plug incorporating an axial column for bracing said at least one elastically deformable lug.

19. Control button according to claim 1 further comprising a fixed sleeve, and wherein said head of said control member includes a skirt guided and restrained from rotation by said fixed sleeve.

20. Control button according to claim 19 wherein said sleeve is in one piece with said guide body.

* * * * *